US007331854B2

(12) United States Patent
Fleming et al.

(10) Patent No.: US 7,331,854 B2
(45) Date of Patent: Feb. 19, 2008

(54) COMMON FILTRATION UNIT FOR BUILDING MAKEUP AIR AND EMERGENCY EXHAUST

(75) Inventors: Robert H. Fleming, Manassas, VA (US); D. James Schooley, Manassas, VA (US)

(73) Assignee: Lockheed Martin Corporation, Manassas, VA (US)

( * ) Notice: Subject to any disclaimer, the term of this patent is extended or adjusted under 35 U.S.C. 154(b) by 107 days.

(21) Appl. No.: 10/964,065

(22) Filed: Oct. 13, 2004

(65) Prior Publication Data

US 2006/0079172 A1 Apr. 13, 2006

(51) Int. Cl.
*F24F 7/06* (2006.01)

(52) U.S. Cl. ..... 454/292

(58) Field of Classification Search ..... 454/353, 454/340, 255, 231–232, 242
See application file for complete search history.

(56) References Cited

U.S. PATENT DOCUMENTS 4,062,400 A * 12/1977 Horowitz ..... 165/248
4,976,749 A 12/1990 Adamski et al.
5,352,274 A 10/1994 Blakley
5,607,647 A * 3/1997 Kinkead ..... 422/122
5,791,983 A * 8/1998 Robertson ..... 454/229
6,063,170 A 5/2000 Deibert
6,123,617 A * 9/2000 Johnson ..... 454/187
6,190,437 B1 2/2001 Forsyth
6,289,974 B1 9/2001 DeGregoria et al.
6,702,875 B2 3/2004 Jagtoyen et al.
6,706,092 B2 3/2004 Rohrbach et al.
2004/0253918 A1 * 12/2004 Ezell et al. ..... 454/239

* cited by examiner

*Primary Examiner*—Steve McAllister
*Assistant Examiner*—Helena Kosanovic
(74) *Attorney, Agent, or Firm*—Dicke, Billig & Czaja, PLLC

(57) ABSTRACT

A building protection system comprises a filtration unit, an air handling unit, an emergency exhaust subsystem, a first damper positioned between the filtration unit and the air handling unit, and a second damper positioned between the emergency exhaust subsystem and the filtration unit. The first damper is selectively opened and the second damper is selectively closed to filter outside air as it enters a building, and the first damper is selectively closed and the second damper is selectively opened to filter inside air as it is exhausted from, the building.

24 Claims, 6 Drawing Sheets

COMMON FILTRATION UNIT FOR BUILDING MAKEUP AIR AND EMERGENCY EXHAUST

BACKGROUND

The present invention generally relates to heating, ventilating, and air-conditioning, (HVAC), and more particularly to use of a common filtration unit for building makeup air and emergency exhaust.

Nuclear, biological, and chemical (NBC) attacks are an increasing threat in the modern world. Occupants of a building can be protected from the release of NBC agents outside or inside the building by filtering the air with NBC filtration units. An NBC filtration unit typically only allows one particle greater than one micrometer in a million to pass through the filtration unit. This requires very high construction standards. In addition, a powerful blower is required to maintain airflow due to a pressure drop through the filtration unit. These filtration units with blowers can cost between $100,000 and $250,000 or more for a typical 16,000 cubic feet per minute (CFM) unit.

Typically, the best defense against an outside release of an NBC agent is to filter the contaminated air before it enters the building through a makeup air unit. For internal releases, the most effective general protection strategy is to exhaust the building from the vicinity of the release of the NBC agent. The exhausted contaminated air is filtered before it is released outside to prevent contamination of neighboring buildings. Typically, the intake air filtration system and the emergency exhaust filtration system require two separate NBC filtration units. Installing and maintaining two NBC filtration units in a building is expensive.

SUMMARY

One aspect of the invention provides a building protection system. The building protection system comprises a filtration unit, an air handling unit, an emergency exhaust subsystem, a first damper positioned between the filtration unit and the air handling unit, and a second damper positioned between the emergency exhaust subsystem and the filtration unit. The first damper is selectively opened and the second damper is selectively closed to filter outside air as it enters a building, and the first damper is selectively closed and the second damper is selectively opened to filter inside air as it is exhausted from the building.

BRIEF DESCRIPTION OF THE DRAWINGS

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

DETAILED DESCRIPTION

Figure 1:
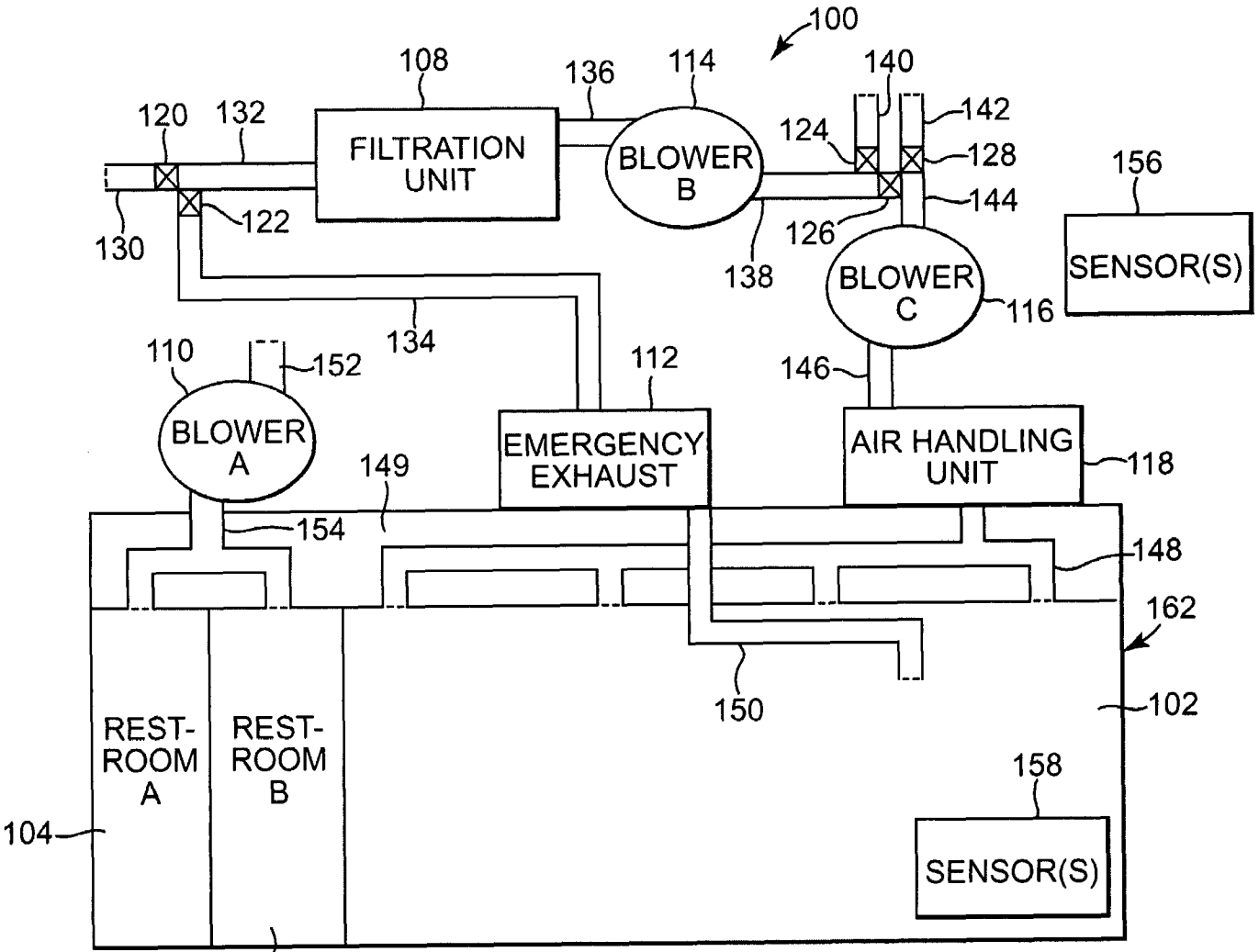
FIG. 1 is a schematic diagram illustrating one embodiment of a building protection system.

FIG. 1 is a schematic diagram illustrating one embodiment of a building protection system 100. Building protection system 100 is a heating, ventilation, and air conditioning (HVAC) system that protects building occupants from the release of nuclear, biological, or chemical (NBC) agents in the air inside or outside building 162. Building protection system 100 includes filtration unit 108, blower A 110, blower B 114, blower C 116, emergency exhaust subsystem 112, air handling unit 118, damper A 120, damper B 122, damper C 124, damper D 126, damper E 128, outside sensor(s) 156, and inside sensor(s) 158. Building protection system 100 also includes air ducting 130-154. Building 162 includes overhead plenum 149, work/living area 102, restroom A 104, and restroom B 106. Work/living area 102 can be partitioned into office areas, conference rooms, "bull pens", etc. One or more of these rooms can be assembled into a protective zone, with sensor 158 coverage and an exhaust duct 150. If multiple protective zones are implemented, then dampers are used to direct the flow of air from the area(s) of known or suspected contamination.

Air duct 130 is coupled to air duct 132 through damper A 120. Air duct 132 is coupled to air duct 134 through damper B 122 and to filtration unit 108. Filtration unit 108 is coupled to blower B 114 through air duct 136. Blower B 114 is coupled to air duct 138. Air duct 138 is coupled to air duct 140 through damper C 124 and to air duct 144 through damper D 126. Air duct 144 is coupled to air duct 142 through damper E 128 and to blower C 116. Blower C 116 is coupled to air handling unit 118 through air duct 146. Air handling unit 118 is coupled to work/living area 102 through supply air ducting 148 and return air from, typically, the overhead plenum 149. Work/living area 102 is coupled to emergency exhaust subsystem 112 through emergency exhaust air ducting 150. Emergency exhaust subsystem 112 is coupled to air duct 134. Restroom A 104 and restroom B 106 are coupled to blower A 110 through exhaust air ducting 154. Blower A 110 is coupled to air duct 152. Inside sensor(s) 158 is located in work/living area 102, and outside sensor(s) 156 is located near air handing unit 118 and blower C 116.

Damper A 120, damper B 122, damper C 124, damper D 126, and damper E 128 are guillotine, butterfly, louver, or any other suitable type of damper. Damper A 120, damper B 122, damper C 124, damper D 126, and damper E 128 are activated pneumatically, hydraulically, electrically, or by using any other suitable method of activation. In one form of the invention, damper A 120, damper B 122, damper C 124, damper D 126, and damper E 128 are rapid response dampers. In one embodiment, damper A 120, damper B 122, damper C 124, damper D 126, and damper E 128 are air tight when in the closed position so that no air passes through the dampers.

Damper A 120 controls the flow of air between air duct 130 and air duct 132. With damper A 120 in an open position, air flows from outside building 162 into air duct 130 to air duct 132. With damper A 120 in a closed position, outside air does not flow into air duct 132 from air duct 130. Damper B 122 controls the flow of air between air duct 134 and air duct 132. With damper B 122 in an open position, air flows from air duct 134 to air duct 132. With damper B 122 in a closed position, air from air duct 134 does not flow into air duct 132. Damper C 124 controls the flow of air from air duct 138 to air duct 140. With damper 124 in an open position, air flows from air duct 138 to air duct 140 to the outside of building 162. With damper C 124 in a closed position, air does not flow from air duct 138 to the outside of building 162. Damper D 126 controls the flow of air between air duct 138 and air duct 144. With damper D 126 in an open position, air flows from air duct 138 to air duct 144. With damper D 126 in a closed position, air does not flow from air duct 126 to air duct 144. Damper E 128 controls the flow of air between air duct 142 and air duct 144. With damper E 128 in an open position, air flows from the outside of building 162 through air duct 142 to air duct 144. With damper E 128 in a closed position, air does not flow from outside of building 162 through air duct 142 to air duct 144. In one embodiment, additional dampers (not shown) can be used for controlling the flow of air into and out of building 162.

In one form of the invention, outside sensor(s) 156 and inside sensor(s) 158 each include a plurality of sensors for detecting the presence of nuclear, biological, and chemical agents. In one embodiment, a sensor, such as inside sensor(s) 158, is provided in each portion of building 162 having separate emergency exhaust air ducting to detect the release of an NBC agent in that portion of building 162.

Filtration unit 108 filters out nuclear, biological, and/or chemical agents from air passing though filtration unit 108 from air duct 132 to air duct 136. In one embodiment, filtration unit 108 includes a filter set. In one form of the invention, the filter set includes a filter for aerosol and absorption, such as a high-efficiency particulate air (HEPA)/ultra low penetration air (ULPA) particulate filter and a carbon gas filter. In one embodiment, filtration unit 108 includes lysing technologies (i.e., UV sterilization lamps).

Blower B 114 draws air through filtration unit 108 from air duct 136 to air duct 138. Blower B 114 is sized to maintain air flow by overcoming a pressure drop through filtration unit 108. In one embodiment, blower B 114 draws air through emergency exhaust subsystem 112.

Blower C 116 draws air from air duct 144 to air duct 146 to air handling unit 118. Air handling unit 118 supplies makeup air to work/living area 102 through supply air ducting 148. In one embodiment, other supply air ducting supplies makeup air to other portions of building 162.

Emergency exhaust subsystem 112 exhausts air from work/living area 102 through emergency exhaust air ducting 150 to air duct 134 in an emergency. In one embodiment, other emergency exhaust air ducting exhausts air from other portions of building 162 in an emergency. In one embodiment, separate emergency exhaust air ducting is provided to separately exhaust air from portions of building 162 where the release of NBC agents has occurred to prevent the spread of the NBC agents to other portions of building 162.

Blower A 110 exhausts air from restroom A 104 and restroom B 106 to the outside of building 162 through exhaust air ducting 154 and air duct 152. In one embodiment, exhaust air ducting 154 exhausts air from kitchens, maintenance closets, laboratories, and/or other rooms in building 162.

Figure 2:
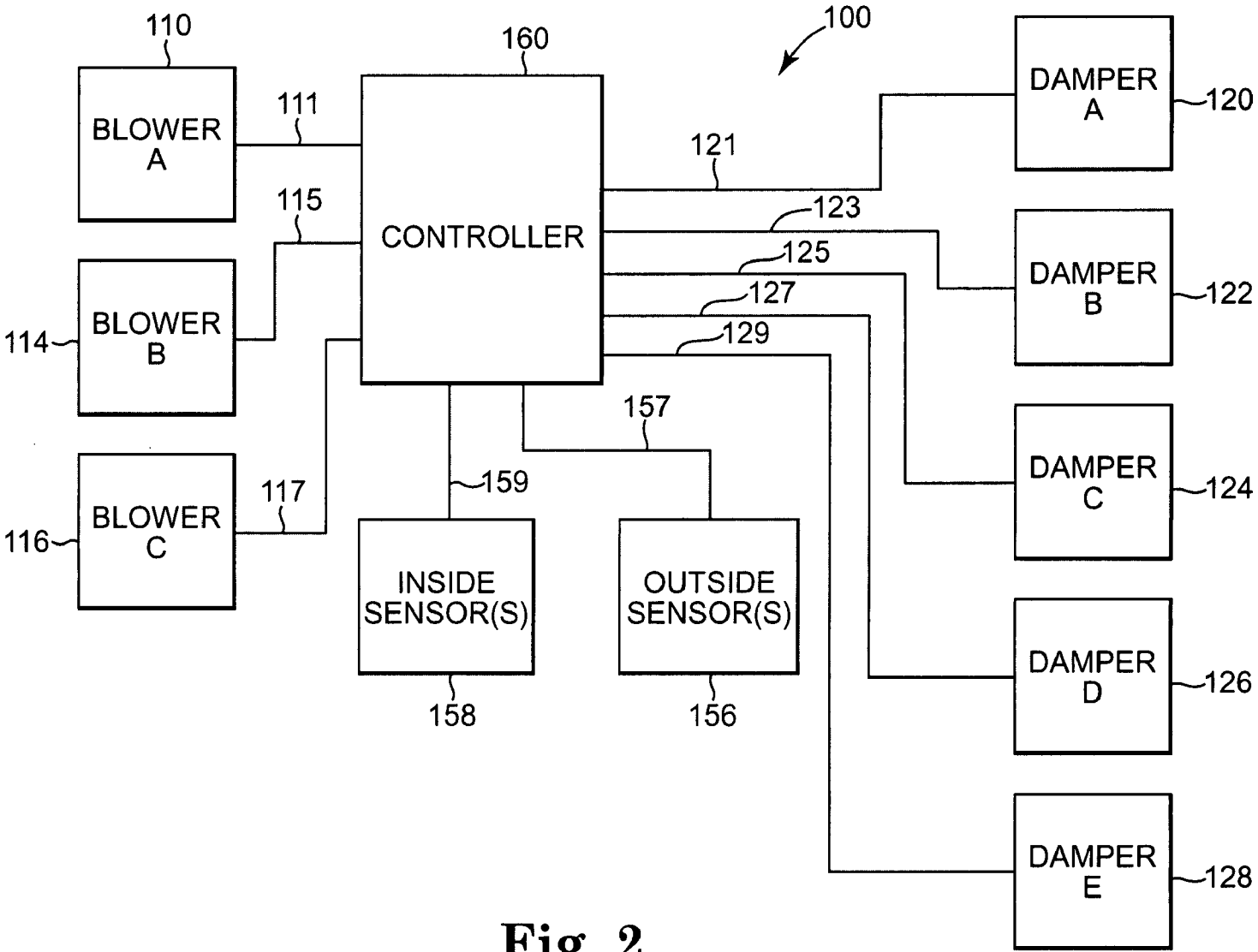
FIG. 2 is a block diagram illustrating one embodiment of a building protection system.

FIG. 2 is a block diagram illustrating one embodiment of building protection system 100. In addition to blower A 110, blower B 114, blower C 116, inside sensor(s) 158, outside sensor(s) 156, damper A 120, damper B 122, damper C 124, damper D 126, and damper E 128, building protection system 100 also includes controller 160. Controller 160 is electrically coupled to blower A 110 through communication link 111, blower B 114 through communication link 115, and blower C 116 through communication link 117. Controller 160 is electrically coupled to inside sensor(s) 158 through communication link 159 and outside sensor(s) 156 through communication link 157. Controller 160 is also electrically coupled to damper A 120 through communication link 121, damper B 122 through communication link 123, damper C 124 through communication link 125, damper D 126 through communication link 127, and damper E 128 through communication link 129.

Controller 160 controls the operation of building protection system 100. Controller 160 includes a combination of hardware and firmware and/or software for controlling blower A 110, blower B 114, blower C 116, damper A 120, damper B 122, damper C 124, damper D 126, and damper E 128, and for receiving sensor data from inside sensor(s) 158 and outside sensor(s) 156.

Controller 160 enables, disables, and controls the speeds of blower A 110, blower B 114, and blower C 116. Controller 160 receives input signals from inside sensor(s) 158 and outside sensor(s) 156 indicating the presence of an NBC agent either inside or outside of building 162 (FIG. 1). Controller 160 opens and closes damper A 120, damper B 122, damper C 124, damper D 126, and damper E 128 based on an operating mode of building protection system 100.

Figure 3:
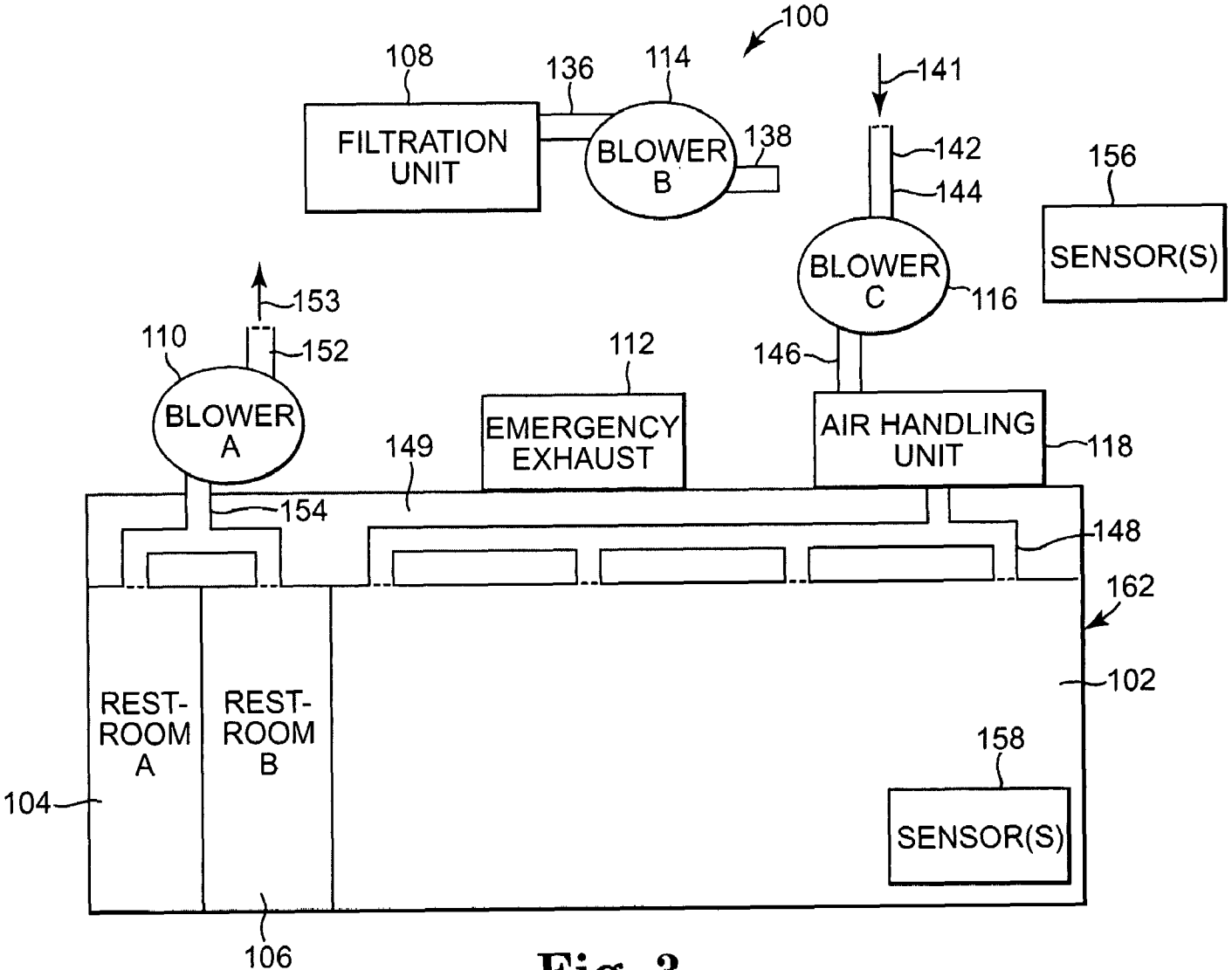
FIG. 3 is a schematic diagram illustrating one embodiment of a building protection system operating in an unprotected mode.
Figure 4:
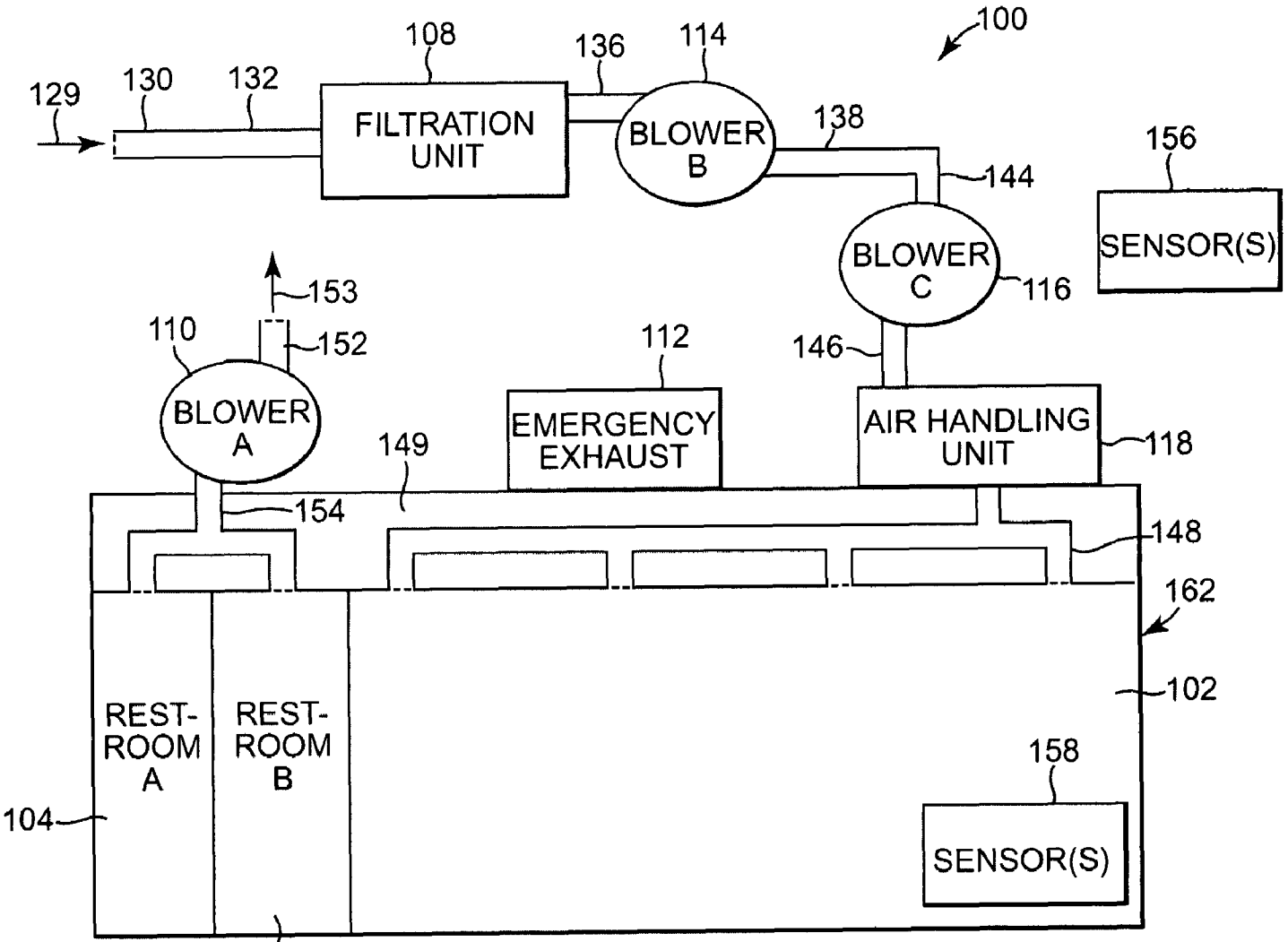
FIG. 4 is a schematic diagram illustrating one embodiment of a building protection system operating in an external release protection mode.
Figure 5:
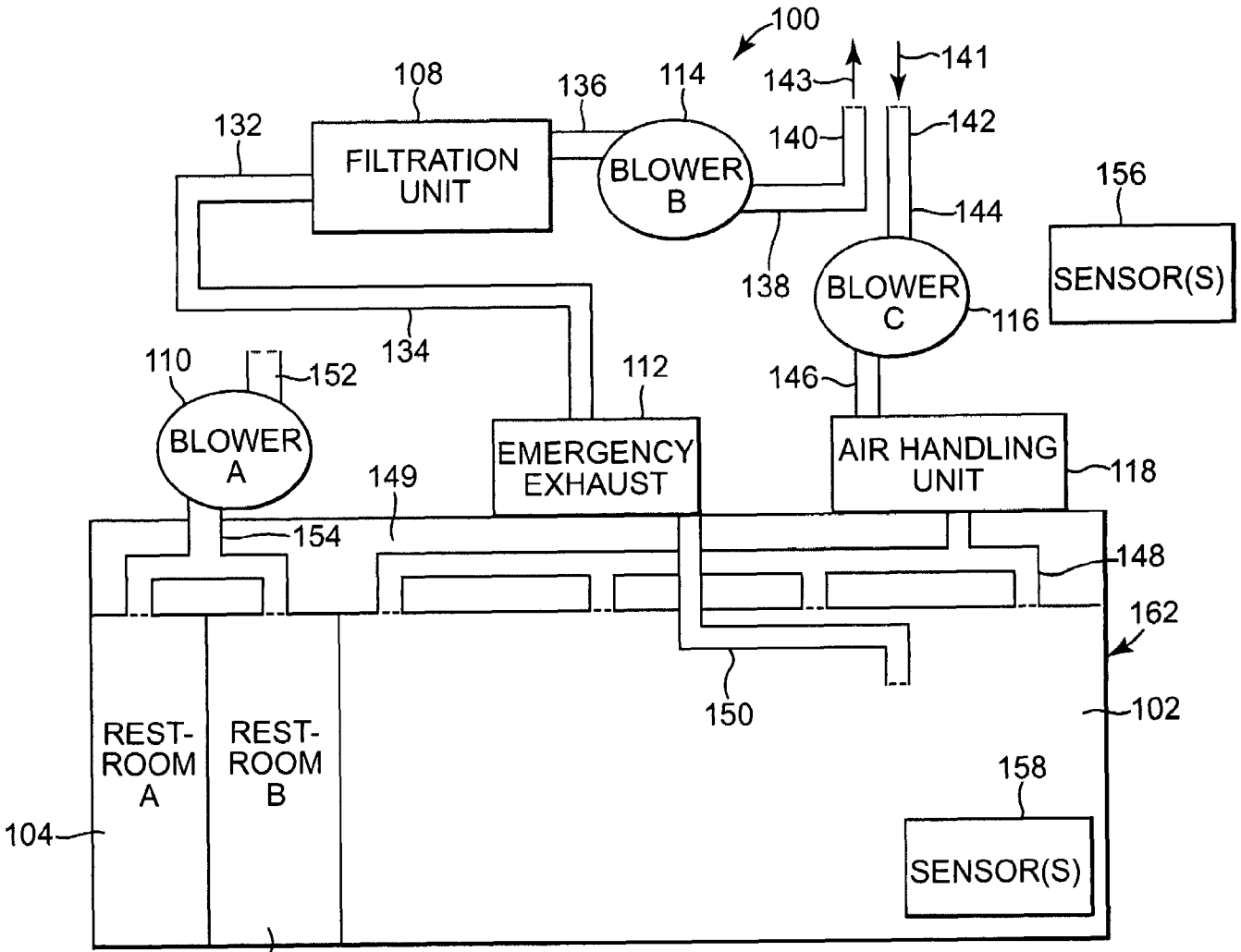
FIG. 5 is a schematic diagram illustrating one embodiment of a building protection system operating in an internal release protection mode.

FIGS. 3-5 illustrate three operational modes for building protection system 100. In one embodiment, the operational modes for building protection system 100 include an unprotected mode, an external release protection mode, and an internal release protection mode. For simplicity, some of the air ducting that is not used in each operational mode is omitted in FIGS. 3-5.

FIG. 3 is a schematic diagram illustrating one embodiment of building protection system 100 operating in the unprotected mode. In the unprotected mode, neither inside sensor(s) 158 nor outside sensor(s) 156 detects NBC agents in the air. In the unprotected mode, controller 160 disables blower B 114, closes damper A 120, damper B 122, damper C 124, and damper D 126, and opens damper E 128. The direction of air flow is indicated by arrows 141 and 153.

In the unprotected mode, controller 160 enables blower C to draw unfiltered air from the outside of building 162 to air handling unit 118 and to work/living area 102. Controller 160 also enables blower A 110 to exhaust air to the outside of building 162 from restroom A 104 and restroom B 106. Building protection system 100 remains in the unprotected mode as long as inside sensor(s) 158 and outside sensor(s) 156 do not detect NBC agents in the air.

FIG. 4 is a schematic diagram illustrating one embodiment of building protection system 100 operating in the external release protection mode. The external release protection mode is activated if outside sensor(s) 156 detects NBC agents in the air. In the external release protection mode, controller 160 opens damper A 120 and damper D 126, and closes damper B 122, damper C 124, and damper E 128. In the external release protection mode, controller 160 enables blower A 110, blower B 114, and blower C 116. The direction of air flow is indicated by arrows 129 and 153.

Blower B 114 draws air through filtration unit 108 from outside building 162 and supplies the filtered air to blower C 116. Blower C 116 supplies the air to air handling unit 118 and to the work/living area 102. In one embodiment, controller 160 reduces the flow of air exhausted from restroom A 104 and restroom B 106 by reducing the speed of blower A 110. The speed of blower A 104 is controlled to create a positive pressure within building 162 such that any air leaking through cracks or crevices in building 162 flows from inside building 162 to the outside of building 162 to prevent unfiltered air from entering building 162. Building protection system 100 remains in the external release protection mode until NBC agents are no longer detected outside building 162.

FIG. 5 is a schematic diagram illustrating one embodiment of building protection system 100 operating in an internal release protection mode. The internal release protection mode is activated if inside sensor(s) 158 detects an NBC agent in the air in work/living area 102. In the internal release protection mode, controller 160 closes damper A 120 and damper D 126, and opens damper B 122, damper C 124, and damper E 128. Controller 160 enables blower B 114 and blower C 116. Controller 160 disables blower A 110 so that no unfiltered air is exhausted from restroom A 104 and restroom B 106. The direction of air flow is indicated by arrows 141 and 143.

Blower B 114 draws contaminated air from work/living area 102 through emergency exhaust air ducting 150, emergency exhaust subsystem 112, air ducts 134 and 132 and filtration unit 108, and exhaust the filtered air to the outside of building 162. At the same time, blower C 116 draws uncontaminated fresh air from the outside of building 162 to air handling unit 118 and work/living area 102. Building protection system 100 remains in the internal release protection mode until the NBC agents are no longer detected inside building 162.

Figure 6:
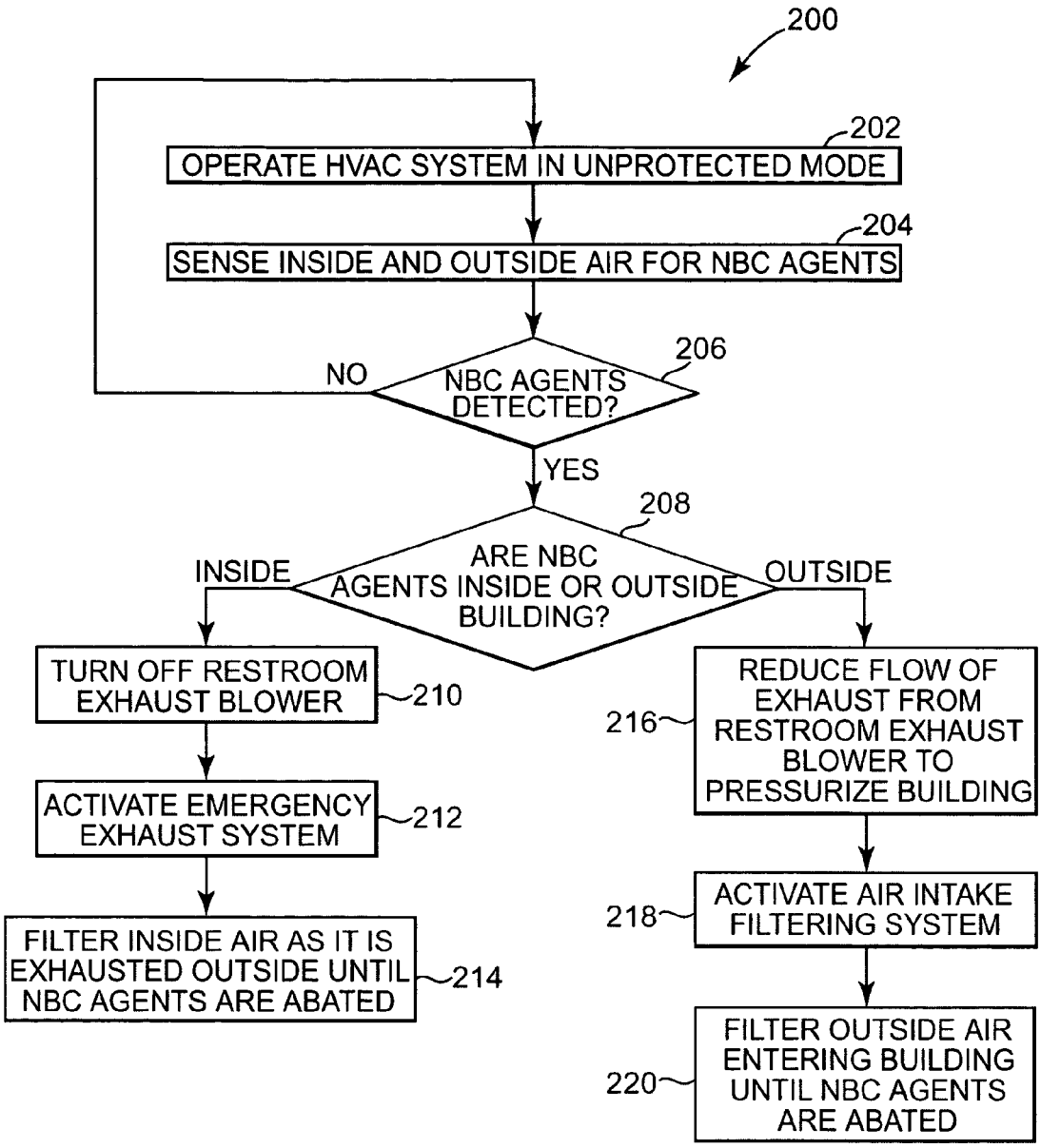
FIG. 6 is a flow diagram illustrating one embodiment of a method for protecting building occupants from a release of a nuclear, biological, or chemical (NBC) agent.

FIG. 6 is a flow diagram illustrating one embodiment of a method 200 for protecting building occupants from a release of an NBC agent either inside or outside of building 162. At 202, the HVAC system is operated in unprotected mode. At 204, sensors inside and outside the building test for the presence of NBC agents. At 206, controller 160 determines whether NBC agents have been detected based on data received from inside sensor(s) 158 and outside sensor (s) 156. If no NBC agents are detected, control returns to block 202 where the HVAC system continues operating in unprotected mode. If NBC agents are detected, controller 160 determines whether the NBC agents are inside or outside of building 162 based on the data received from inside sensor(s) 158 and outside sensor(s) 156.

If the NBC agents are detected inside of building 162, at 210, controller 160 disables the restroom exhaust blower A 110. At 212, controller 160 activates the internal release protection mode to filter the exhausted air before it is released to the outside of building 162. At 214, the air inside building 162 is filtered as it is exhausted to the outside of building 162 until the NBC agents are abated.

If the NBC agents are detected outside building 162, then at 216, controller 160 reduces the flow of air from restroom exhaust blower A 110 to pressurize building 162. At 218, controller 160 activates the external release protection mode to filter the outside air before the air is introduced into building 162. At 220, the outside air continues to be filtered before it enters building 162 until the NBC agents are abated.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A building protection system comprising:
a filtration unit;
an air handling unit;
an emergency exhaust subsystem configured to exhaust inside air from a building to an atmosphere;
a first damper positioned between the filtration unit and the air handling unit; and
a second damper positioned between the emergency exhaust subsystem and the filtration unit,
wherein the first damper is selectively opened and the second damper is selectively closed to filter outside air via the filtration unit as it enters the building, and the first damper is selectively closed and the second damper is selectively opened to filter inside air as it is exhausted from the building via the filtration unit.

2. The building protection system of claim 1, further comprising:
a blower coupled to the air handling unit, the blower adapted to supply air to the air handling unit.

3. The building protection system of claim 2, wherein the blower is adapted to pressurize the building with the first damper closed and the second damper opened.

4. The building protection system of claim 1, wherein the filtration unit comprises nuclear, biological, and chemical (NBC) filters, and lysing technologies.

5. The building protection system of claim 1, further comprising:
a blower coupled to the filtration unit, the blower adapted to draw air through the filtration unit.

6. The building protection system of claim 1, wherein the first damper comprises a first rapid response damper and the second damper comprises a second rapid response damper.

7. The building protection system of claim 1, further comprising:
a controller adapted to selectively open and close the first damper and the second damper.

8. The building protection system of claim 7, further comprising:
a sensor coupled to the controller, the sensor adapted for sensing NBC agents in air inside the building, and wherein the controller is adapted to close the first damper and open the second damper in response to the sensor sensing NBC agents in air inside the building.

9. The building protection system of claim 7, further comprising:
a sensor coupled to the controller, the sensor adapted for sensing NBC agents in air outside the building, and wherein the controller is adapted to open the first damper and close the second damper in response to the sensor sensing NBC agents in air outside the building.

10. The building protection system of claim 1, further comprising:

a blower coupled to ventilation air ducting, the blower adapted to ventilate air from inside the building to outside the building without passing the air through the filtration unit.

11. A building protection system comprising:

a filtration unit;

an air handling unit;

an emergency exhaust subsystem configured to exhaust inside air from a building to an atmosphere;

a first damper positioned between the filtration unit and the air handling unit;

a second damper positioned between the emergency exhaust subsystem and the filtration unit;

an inside sensor adapted to sense nuclear, biological, and chemical (NBC) agents in air inside the building;

an outside sensor adapted to sense NBC agents in air outside the building; and a controller coupled to the first damper, the second damper, the inside sensor, and the outside sensor, the controller adapted to open the first damper and close the second damper to filter outside air via the filtration unit as it enters the building in response to the outside sensor sensing an NBC agent, and close the first damper and open the second damper to filter inside air via the filtration unit as it is exhausted from the building in response to the inside sensor sensing an NBC agent.

12. The building protection system of claim 11, further comprising:

a first blower coupled to the filtration unit, the first blower adapted to draw air through the filtration unit.

13. The building protection system of claim 12, further comprising:

a second blower coupled to the air handling unit, the second blower adapted to supply air to the air handling unit.

14. The building protection system of claim 13, further comprising:

a third blower coupled to exhaust air ducting, the third blower adapted to exhaust air from inside the building to outside the building without passing the air through the filtration unit.

15. The building protection system of claim 14, wherein the exhaust air ducting is coupled to restrooms in the building.

16. The building protection system of claim 14, further comprising:

supply air ducting coupled to the air handling unit, the supply air ducting adapted to supply air to work/living areas of the building.

17. The building protection system of claim 14, further comprising:

emergency exhaust air ducting coupled to the emergency exhaust subsystem, the emergency exhaust air ducting adapted to exhaust air from work/living areas of the building.

18. A building protection system comprising:

means for supplying outside air to a building;

means for exhausting air from inside the building to an atmosphere; and a single means for selectively filtering the outside air supplied to the building and the exhausted air from inside the building of nuclear, biological, and chemical (NBC) agents.

19. The building protection system of claim 18, further comprising:

means for sensing NBC agents; and means for controlling the single means for selectively filtering based on the sensed NBC agents.

20. A method for protecting the occupants of a building from a release of a nuclear, biological, or chemical (NBC) agent, the method comprising:

providing a filtration unit;

providing an air handling unit;

providing an emergency exhaust subsystem configured to exhaust inside air from the building to an atmosphere;

providing a first damper positioned between the filtration unit and the air handling unit;

providing a second damper positioned between the emergency exhaust subsystem and the filtration unit;

sensing a release of an NBC agent in one of inside the building and outside the building;

opening the first damper and closing the second damper to filter outside air via the filtration unit as it enters the building in response to sensing the release of an NBC agent outside the building; and closing the first damper and opening the second damper to filter inside air via the filtration unit as it is exhausted from the building in response to sensing the release of an NBC agent inside the building.

21. The method of claim 20, wherein sensing the release of the NBC agent inside the building comprises sensing a location in the building of the release of the NBC agent.

22. The method of claim 20, wherein providing a filtration unit comprises providing a filtration unit comprising an NBC filter.

23. The method of claim 20, further comprising:

filtering the air until the release of the NBC agent has been abated.

24. The method of claim 20, further comprising:

pressurizing the building in response to sensing the release of an NBC agent outside the building.

* * * * *

UNITED STATES PATENT AND TRADEMARK OFFICE

CERTIFICATE OF CORRECTION

PATENT NO. : 7,331,854 B2
APPLICATION NO. : 10/964065
DATED : February 19, 2008
INVENTOR(S) : Robert H. Fleming et al.

It is certified that error appears in the above-identified patent and that said Letters Patent is hereby corrected as shown below:

On the Title Page Item (73)

Please delete Assignee: Lockheed Martin Corporation, Manassas, VA (US)

and insert in place thereof

Assignee: Lockheed Martin Corporation, Bethesda, MD (US)

Signed and Sealed this

Twenty-ninth Day of July, 2008

JON W. DUDAS
*Director of the United States Patent and Trademark Office*